US010844783B2

(12) United States Patent
Obrist

(10) Patent No.: US 10,844,783 B2
(45) Date of Patent: Nov. 24, 2020

(54) GENERATOR SET

(71) Applicant: OBRIST TECHNOLOGIES GMBH, Lustenau (AT)

(72) Inventor: Frank Obrist, Bregenz (AT)

(73) Assignee: OBRIST TECHNOLOGIES GMBH (AT)

( * ) Notice: Subject to any disclaimer, the term of this patent is extended or adjusted under 35 U.S.C. 154(b) by 0 days.

(21) Appl. No.: 16/073,220

(22) PCT Filed: Feb. 6, 2017

(86) PCT No.: PCT/EP2017/052508

§ 371 (c)(1),
(2) Date: Jul. 26, 2018

(87) PCT Pub. No.: WO2017/134294

PCT Pub. Date: Aug. 10, 2017

(65) Prior Publication Data

US 2019/0032554 A1 Jan. 31, 2019

(30) Foreign Application Priority Data

Feb. 5, 2016 (DE) ..... 10 2016 102 048

(51) Int. Cl.

| | |
|---|---|
| ***F02B 75/22*** | (2006.01) |
| ***F02F 1/24*** | (2006.01) |
| ***F02B 69/00*** | (2006.01) |
| ***F02B 75/06*** | (2006.01) |
| ***F02B 63/04*** | (2006.01) |
| *F02B 75/18* | (2006.01) |

(52) U.S. Cl.

CPC ..... *F02B 75/225* (2013.01); *F02B 63/042* (2013.01); *F02B 69/00* (2013.01);

(Continued)

(58) Field of Classification Search

CPC ..... F02B 75/225; F02B 63/042; F02B 69/00; F02B 75/065; F02F 1/24

See application file for complete search history.

(56) References Cited

U.S. PATENT DOCUMENTS 2,596,410 A * 5/1952 Le Grand ..... F02B 73/00 123/59.6
4,121,558 A 10/1978 Sakakibara et al.

(Continued)

FOREIGN PATENT DOCUMENTS

CN 1928328 A 3/2007
CN 200978717 Y 11/2007

(Continued)

OTHER PUBLICATIONS

Erjavec, Jack. Essay. In Tech Manual to Accompany Automotive Technology: a Systems Approach, 563. United States: Delmar, 2000. (Year: 2000).*

(Continued)

*Primary Examiner* — Kevin A Lathers
(74) *Attorney, Agent, or Firm* — Cesari and McKenna, LLP

(57) ABSTRACT

The invention relates to a generator set, in particular a generator set of a hybrid vehicle, with a two-cylinder piston engine (1), which has a crankshaft housing (10), in which two counter-rotating crankshafts (11, 12) are arranged, which are connected by means of piston rods (13) to pistons (18, 19), which are guided inside two cylinders (21, 22) in a tandem arrangement, wherein at least one crankshaft (11, 12) is drivingly connected to a generator (41, 42), and wherein the piston engine (1) comprises a cylinder head (20), which is connected to the crankshaft housing (10), wherein the piston engine (1) has a lower-mounted camshaft (30), and the cylinder head (20) can be connected to the crankshaft housing (10) in at least two positions, in particular positions rotated through 180° relative to each other. Furthermore, the invention relates to a vehicle with such a generator set.

18 Claims, 4 Drawing Sheets

Figure 1B:
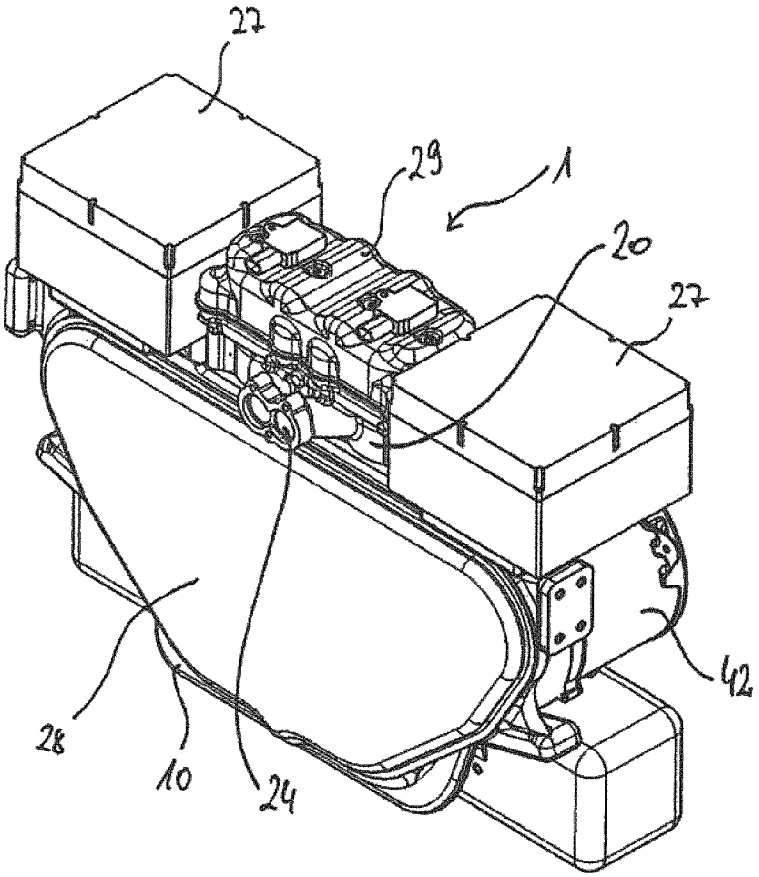

(52) U.S. Cl.
CPC ..... *F02B 75/065* (2013.01); *F02B 75/228* (2013.01); *F02F 1/24* (2013.01); *F02B 2075/1808* (2013.01); *F02B 2275/02* (2013.01)

(56) References Cited

U.S. PATENT DOCUMENTS

| | | | | |
|---|---|---|---|---|
| 6,280,158 | B1 | 8/2001 | Itoh et al. | |
| 2005/0051115 | A1 | 3/2005 | Wenger et al. | |
| 2005/0155581 | A1* | 7/2005 | Wells | F02D 41/064 123/491 |
| 2013/0319349 | A1* | 12/2013 | Obrist | B60K 6/24 123/2 |

FOREIGN PATENT DOCUMENTS

| | | | | | |
|---|---|---|---|---|---|
| DE | 195 42 758 | A1 | | 5/1996 | |
| DE | 10 2004 041 958 | A1 | | 3/2006 | |
| DE | 10 2005 048 561 | A1 | | 4/2007 | |
| FR | 915993 | A | | 11/1946 | |
| GB | 324409 | A | | 1/1930 | |
| GB | 324410 | A | * | 1/1930 | H02K 7/1815 |
| GB | 463 278 | A | | 3/1937 | |
| GB | 584 215 | A | | 1/1947 | |
| JP | 52017107 | A | | 2/1977 | |
| JP | 63097829 | A | | 4/1988 | |
| JP | 1988097829 | A | | 4/1988 | |
| JP | S6397829 | A | | 4/1988 | |
| JP | 2000205040 | A | | 7/2000 | |
| JP | 2008255971 | A | | 10/2008 | |
| JP | 2015020598 | A | | 2/2015 | |
| WO | WO 2012/ 056 275 | A1 | | 5/2012 | |
| WO | WO-2012163902 | A1 | | 12/2012 | |

OTHER PUBLICATIONS

Korean office action dated Feb. 17, 2020 regarding Korean application No. 10-2018-7020842, applicant Obrist Technologies GmbH.

* cited by examiner

GENERATOR SET

CROSS REFERENCE TO RELATED APPLICATIONS

This application is the National Stage of International Application No. PCT/EP2017/052508, filed Feb. 6, 2017, which claims the benefit of German Patent Application No. 102016102048.6 filed on Feb. 5, 2016. The contents of both applications are hereby incorporated by reference in their entirety.

The invention relates to a generator set, in particular a generator set of a hybrid vehicle, and to a vehicle with such a generator set. A generator set of the type cited in the introduction is of known art, for example, from WO 2012/056275 A1.

The generator set of known art comprises a two-cylinder piston engine with two pistons, which are guided inside two cylinders in a tandem arrangement. Each piston is connected with a respective crankshaft by means of a piston rod. The two crankshafts rotate in opposite directions. The two-cylinder piston engine furthermore comprises a crankshaft housing, in which the crankshafts are arranged. Furthermore a generator is provided that is drivingly connected with at least one crankshaft. A cylinder head is fitted onto the crankshaft housing; this is fixedly connected to the crankshaft housing.

The generator set of prior known art is preferably deployed in a hybrid vehicle. In such hybrid vehicles the space required for the energy storage elements, in particular storage batteries (energy accumulators), is particularly large, so that a reduction in the build size of the generator set is desirable. Also to be considered is the desired installation location of the generator set in a vehicle. For reasons of weight distribution it is advantageous to place the generator set as close as possible to a bulkhead of the engine compartment. Here exhaust pipes or air intake manifolds that are connected to the cylinder head can be an obstruction. In this respect the requirement is for a generator set that can be integrated with the vehicle in a flexible and space-saving manner.

Against this background the object underlying the present invention is to improve a generator set of the type cited in the introduction, such that as a result the generator set can be flexibly deployed under various installation conditions. A further object of the invention consists in the specification of a vehicle with such a generator set.

In accordance with the invention the object with regard to the generator set is achieved by means of the subject matter of patent claim 1. With regard to the vehicle the object is achieved by means of the subject matter of patent claim 11.

The invention is thus based on the concept of specifying a generator set, in particular a generator set of a hybrid vehicle, with a two-cylinder piston engine that has a crankshaft housing. Two counter-rotating crankshafts are arranged in the crankshaft housing; these are connected to two pistons by means of piston rods. The pistons are guided inside two cylinders in a tandem arrangement.

At least one crankshaft is drivingly connected with a generator. The piston engine has a cylinder head that is connected to the crankshaft housing. The piston engine preferably has a lower-mounted camshaft. The cylinder head can be connected to the crankshaft housing in at least two positions rotated relative to each other, in particular through 180°.

The combination of the lower-mounted camshaft and the cylinder head that can be rotatably connected to the crankshaft housing has particular advantages associated with it. The lower-mounted camshaft ensures, in particular, that the generator set can have a small build size. The cylinder head, which can be connected to the crankshaft housing in two different positions, contributes to this, inasmuch as the arrangement of the generator set within the vehicle can be configured in a flexible manner. Thus the generator set, depending on the installation conditions, requires a minimum of build space in the vehicle, since the cylinder head, which can be connected with the crankshaft housing in different ways, enables appropriate routing for the air intake manifolds or exhaust pipes.

For example, the generator set can be positioned comparatively close to a bulkhead in an engine compartment, since the cylinder head can be oriented such that the air intake pipe or exhaust pipe protrudes forward from the cylinder head in the direction of travel. A larger proportion of available volume thus remains in the engine compartment, which can, for example, be used by storage elements. If, however, the generator set is arranged horizontally, a different routing for the pipework can be advantageous. Inasmuch as the cylinder head can be connected to the crankshaft housing in different positions, the generator set can be flexibly installed.

In particular provision is preferably made for the cylinder head to have a symmetrical build. Specifically, the connecting surfaces or rather connecting openings in the cylinder head and/or in the crankshaft housing can be arranged axisymmetrically relative to a central axis of the generator set, so that the orientation of the cylinder head with respect to the crankshaft housing can be freely chosen. In other words the cylinder head can be connected as required in two different orientations relative to the crankshaft housing, wherein at the same time, regardless of the orientation of the cylinder head with respect to the crankshaft housing, the respective connecting openings are congruent with each other.

In a preferred embodiment of the invention provision is made for the camshaft to be arranged in a central plane between the crankshafts. In particular the camshaft can be arranged in the central plane between the piston rods of the pistons. In this manner the available space between the piston rods of the pistons is utilised in a particularly efficient manner, which contributes to the compactness of the generator set.

The camshaft is preferably arranged below a bottom dead centre of the pistons. This also leads to the fact that the generator set has a particularly compact design. In particular the pistons can be moved closer to each other without the piston rods or cylinders colliding with the camshaft.

The cylinder head preferably has an intake stub pipe for an ignition mixture and an outlet stub pipe for exhaust gases. The intake stub pipe and the outlet stub pipe are preferably arranged on opposite sides of the cylinder head.

The camshaft is preferably drivingly connected with one of the crankshafts via a belt drive or a chain drive. The camshaft can have at least one cam, which is coupled with a control rod. The control rod is preferably operatively connected with a rocker arm of a valve in the cylinder head. The control rod translates the external contour of the cam into a rocking movement of the rocker arm, so that the valve in the cylinder head can be opened and closed by way of the cam contour.

In the present invention it is particularly preferable if the camshaft comprises a plurality of cams, in particular four cams, each of which is coupled with a control rod. Here provision is preferably made for the control rod, in particular all control rods, to be arranged between the two cylinders. This arrangement of the control rods also utilises the remaining free space between the cylinders and pistons very efficiently, thereby contributing to the compact build of the generator set.

In a preferred embodiment of the invention the two crankshafts can each carry a toothed spur gear, wherein the spur gears of the two crankshafts intermesh and couple the crankshafts with each other in phase. By virtue of the intermeshing of the spur gears of the crankshafts the movements of the two pistons are forced into a mutual dependency. This promotes the synchronism of the generator set.

Each crankshaft preferably carries a flywheel with a balance mass. At the same time least one flywheel can have circumferential markings for the detection of a crankshaft position by means of a crankshaft sensor. Specifically, provision can be made for one of the flywheels to have external tooth forms, wherein the external tooth forms are spaced at essentially equal intervals. An exception exists at one point on the flywheel circumference, where the external tooth form can have a longer gap. The longer gap is preferably arranged such that when it passes an appropriate sensor, for example an optical sensor, it signals that one of the two pistons is located at its bottom or top dead centre. In any event, the position of the crankshaft can be determined by means of such markings and can be used to regulate the generator set.

Figure 1A:
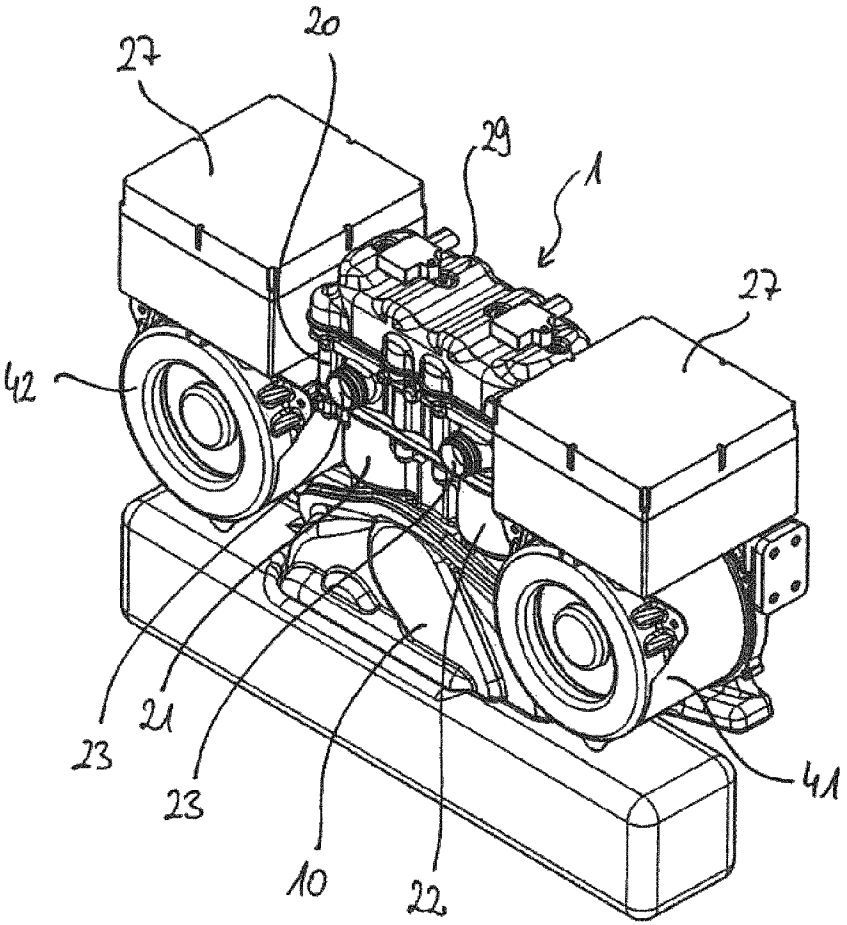

A further aspect of the invention relates to a vehicle, in particular a single-track or a multi-track hybrid motor vehicle, with a generator set as described above. In the vehicle the generator set is preferably arranged in the engine compartment on a bulkhead, wherein the bulkhead separates a passenger compartment from the engine compartment. It is advantageous that the generator set can be installed in two different orientations in the engine compartment, as a result of which the generator set is universally suitable for a multiplicity of vehicle shapes. In what follows the invention will be explained in more detail with the aid of an embodiment, with reference to the attached schematic drawings, in which FIG. 1*a* shows a perspective front view of a generator set in accordance with the invention by way of a preferred embodiment;

FIG. 1*b* shows a perspective rear view of the generator set in FIG. 1*a;*

Figure 1C:
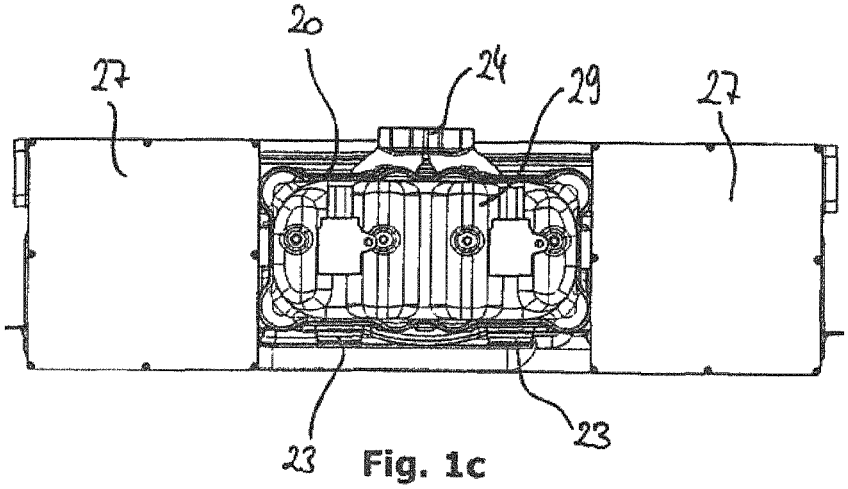

FIG. 1*c* shows a plan view onto the generator set in FIG. 1*a;*

Figure 1D:
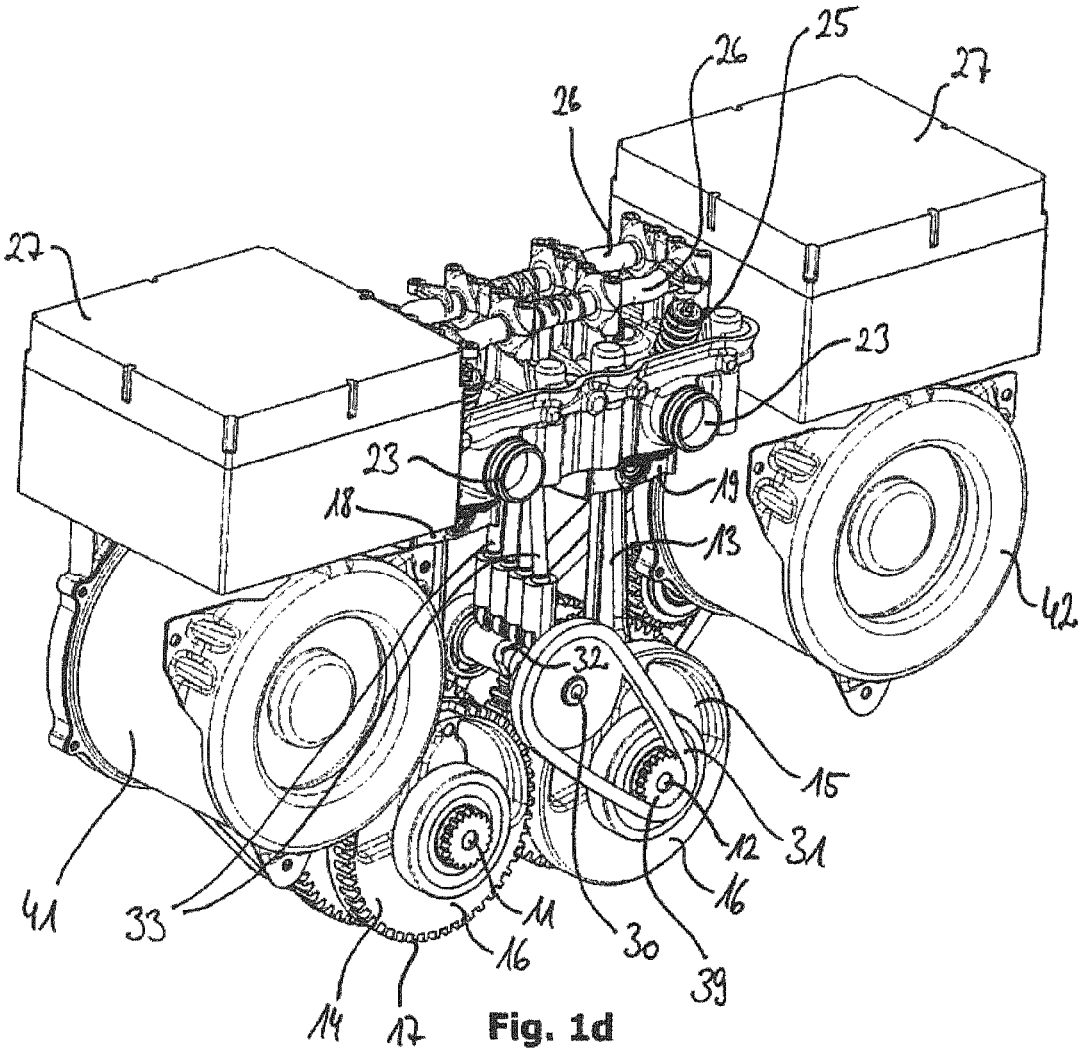
Figure 2B:
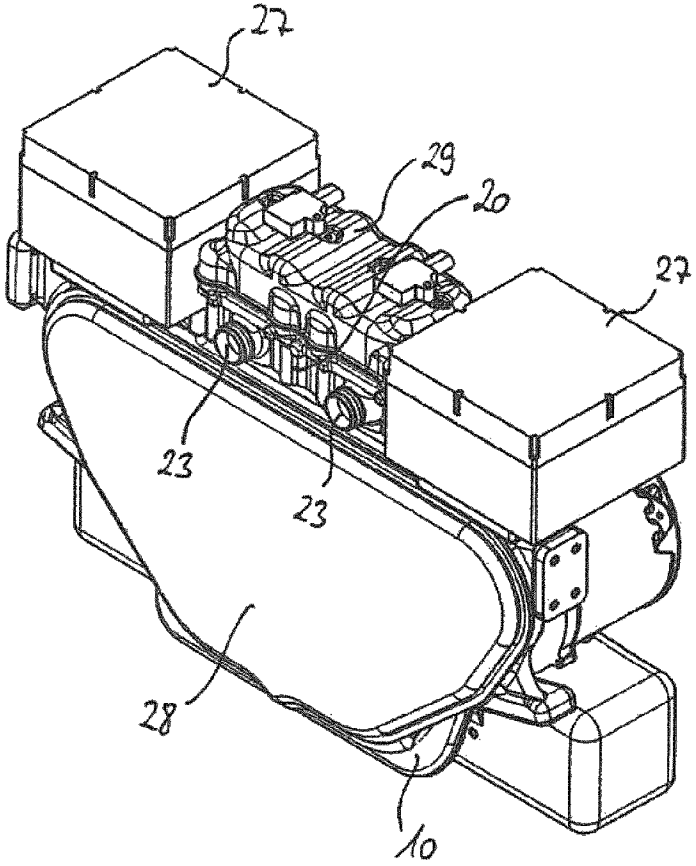
Figure 2A:
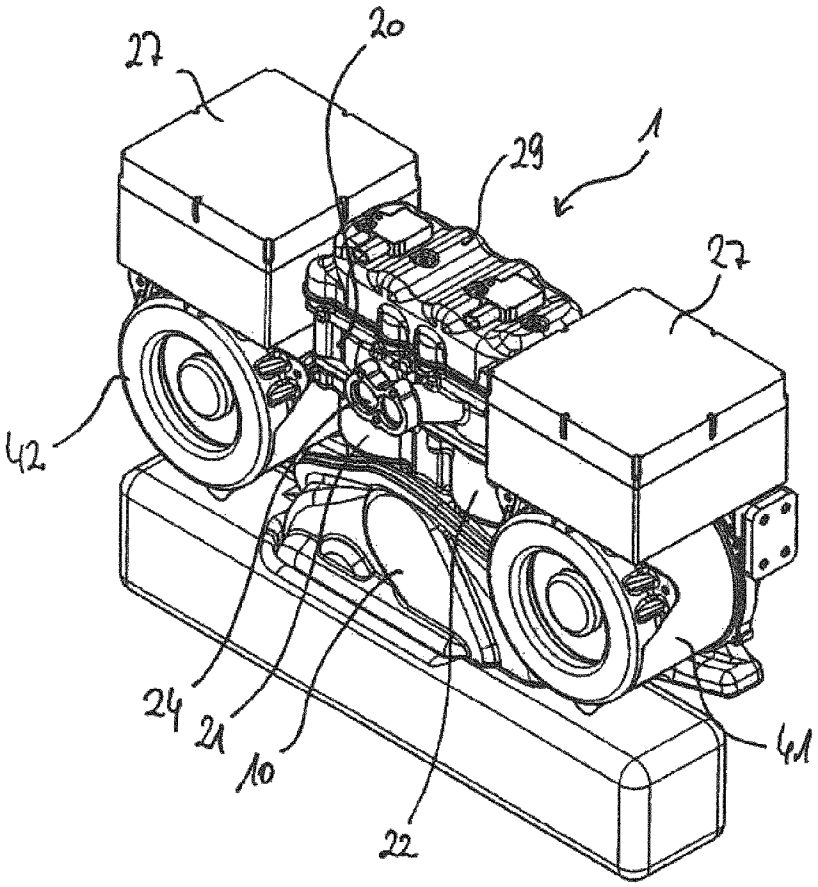

FIG. 1*d* shows a perspective front view of the generator set in FIG. 1*a* without a crankshaft housing;

FIG. 2*a* shows a perspective front view of the generator set in FIG. 1*a*, wherein the cylinder head as fitted has been rotated through 180°;

FIG. 2*b* shows a perspective rear view of the generator set in FIG. 2*a;*

Figure 2C:
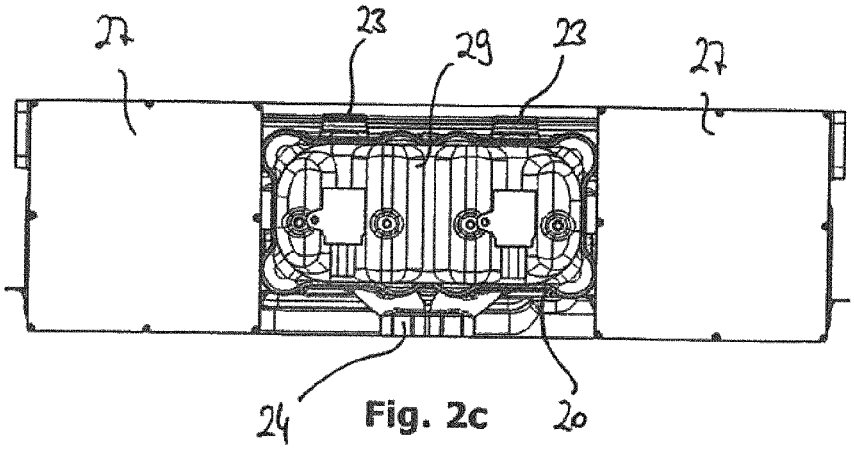

FIG. 2*c* shows a plan view onto the generator set in FIG. 2*a*; and

Figure 3:
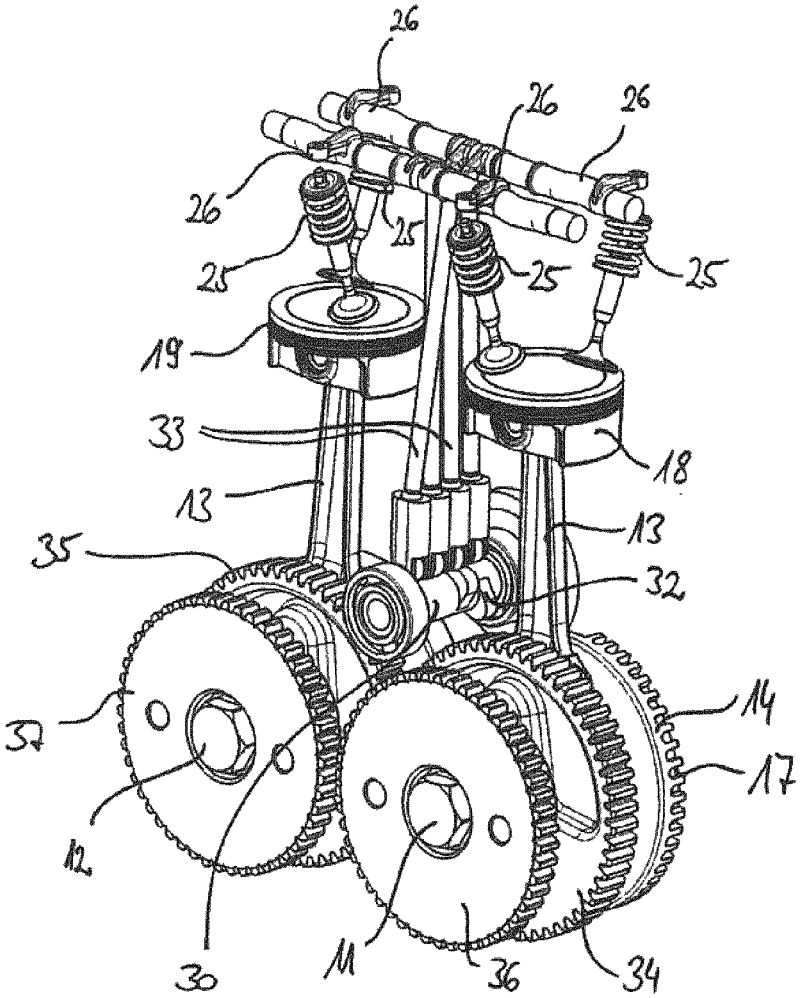

FIG. 3 shows a perspective rear view of the piston arrangement of the generator set in FIG. 1*a*.

The attached figures show in overall terms a generator set, in particular a generator set of a hybrid vehicle, which has a two-cylinder piston engine 1. The two-cylinder piston engine is mechanically coupled with generators 41, 42. The generators 41, 42 generate power, which is used, for example, to charge a drive battery.

The two-cylinder piston engine 1 comprises a crankshaft housing 10, in which are arranged a first crankshaft 11 and a second crankshaft 12. The first crankshaft 11 and the second crankshaft 12 are respectively connected via piston rods 13 to a first piston 18 and a second piston 19. The pistons 18, 19 are guided inside two cylinders 21, 22 in a tandem arrangement. The cylinders 21, 22 are arranged in a cylinder head 20. The cylinder head 20 furthermore has two intake stub pipes 23 and one outlet stub pipe 24. Combustion air can be sucked in via the intake stub pipes and fed into the cylinders 21, 22. Exhaust gases generated in the cylinders 21, 22 are discharged via the outlet stub pipe 24.

As is clearly apparent in FIG. 1*a*, the generators 41, 42 are arranged laterally next to the two-cylinder piston engine 1. In particular, the two-cylinder piston engine 1 is essentially arranged between the two generators 41, 42. The generators 41, 42, in particular, are arranged in line with the two-cylinder piston engine 1, the result of which is a particularly slim design for the generator set.

Electronics housings 27 are provided level with the cylinder head 20 on both sides of the two-cylinder piston engine 1; these can contain power electronics. The electronics housings 27 are in each case arranged above a generator 41, 42. The power electronics arranged in the electronics housings 27 can in each case be electrically connected to one of the generators 41, 42.

FIG. 1*b* shows a rear view of the generator set, wherein it is apparent that in the variant of FIGS. 1*a*-1*d* the outlet stub pipe 24 of the cylinder head 20 is oriented towards the rear face. A cover 28 is provided on the rear face of the generator set. The cover 28 covers the spur gears 34, 35, which are non-rotatably connected to the crankshafts 11, 12.

FIG. 1*c* shows a plan view onto the generator. It is apparent that as a result of the arrangement of the generators 41, 42 and the electronics housings 27 a particularly compact, in particular slim, design of the generator set is achieved. In addition the configuration of the cylinder head 20 is clearly apparent in the plan view.

The cylinder head 20 has the outlet stub pipe 24 on one face. The outlet stub pipe 24 is designed with two ports and opens out into each of the cylinders 21, 22. The intake stub pipes 23 are arranged on an opposite face of the cylinder head 20. The intake stub pipes 23 are arranged spaced apart from each other, and in each case open out directly into the first cylinder 21 and the second cylinder 22 respectively. A separate intake stub pipe 23 is assigned to each of the cylinders 21, 22.

In addition it is apparent in the plan view of FIG. 1*c* that the cylinder head 20 is designed essentially axisymmetrically with reference to an axis of symmetry vertical to the plane of the drawing. This has the advantage that the cylinder head 20 can be fitted onto the crankshaft housing 10 in two different orientations. In particular the cylinder head 20 can be fitted onto the crankshaft housing 10 in an orientation rotated through 180°, so that the exhaust pipe 24 is oriented, not towards a rear face, but towards a front face of the generator set.

In FIGS. 2*a*-2*c* the generator set can be discerned, whereby the cylinder head 20 is fitted onto the crankshaft housing 10 in a position rotated through 180°. The components of the generator set shown in FIGS. 1*a*-1*d* are essentially identical to the components of the generator set shown in FIGS. 2*a*-2*c*. The difference consists simply in the fact that in the assembly shown in FIGS. 1*a*-1*d* the cylinder head 20 is fitted onto the crankshaft housing 10 in an orientation displaced through 180° relative to the assembly shown in FIGS. 2*a*-2*c*.

In FIG. 1*c*, looking from above, a valve cover 29 is also apparent, which is fitted onto the cylinder head 20. FIG. 1*d*, in contrast, shows the internal layout of the generator set, wherein in the interests of clarity the crankshaft housing 10 and the valve cover 29 have been omitted.

As is clearly apparent in FIG. 1*d*, the generator set has two crankshafts 11, 12, which are coupled in phase with each other. The coupling is effected via the spur gears 34, 35, which have intermeshing teeth. The spur gears 34, 35 are arranged on a rear face of the generator set and are clearly apparent in the exposed illustration of FIG. 3. A drive wheel 36, 37 sits on each spur gear 34, 35. Each drive wheel 36, 37 is coupled via a belt or a chain with a drive wheel of one of the generators 41, 42. The coupling of the crankshaft 11, 12 with the respectively assigned generator 41, 42 is thus effected via the drive wheel 36, 37, coaxially connected to the crankshaft 11, 12, a belt drive or chain drive, and the drive wheel on the generator, which is non-rotatably coaxially connected to a generator shaft.

FIG. 1*d* shows a further essential aspect of the generator set, which contributes to the reduction in the build size of the generator set. Specifically, FIG. 1*d* shows the camshaft 30, which is located between the crankshafts 11, 12. The camshaft 30 extends, in particular, between the piston rods 13 and below the cylinder head 20. Specifically, the piston rods 13, with the cylinder head 20 and the crankshafts 11, 12, bound a free space, which is utilised efficiently by the camshaft 30. In particular, the camshaft 30 is arranged on a centre line between the two crankshafts 11, 12. The drive of the camshaft 30 is effected via a belt drive 31. The belt drive 31 connects a toothed wheel 39 of the second crankshaft 12 to the camshaft 30.

In the embodiment shown the camshaft 30 has four cams 32, to each of which is assigned a control rod 33. The control rods 33 extend from the camshaft 30 through the crankshaft housing 10 and the cylinder head 20 into the valve chamber below the valve cover 29. In the valve chamber are arranged rocker arms 26, which interact with the valves 25. An external contour of the cam 32 is thus sensed by way of the control rod 33 and converted into a corresponding position of the rocker arm 26. In the embodiment illustrated here, it is preferable if a total of four valves are provided. A valve 25 is thus assigned to each control rod 33.

FIGS. 2*a* and 2*b* show a generator set, which is essentially designed in an analogous manner to the generator set in FIGS. 1*a*, 1*b*. In any event, the individual components are identical. The illustration in FIGS. 2*a*, 2*b* differs from the assembly in FIGS. 1*a*, 1*b* in terms of the rotated arrangement of the cylinder head 20. In FIG. 2*a* it is apparent that, in contrast to the arrangement in FIG. 1*a*, the cylinder head 20 is mounted onto the crankshaft housing 10 such that the outlet stub pipe 24 is directed towards the front face of the generator set. Similarly the valve cover 29, in contrast to the assembly in FIG. 1*a*, is fitted in a position rotated through 180°. The same is essentially true for the illustration in FIG. 2*b*, where it is apparent, compared to the illustration in FIG. 1*b*, that the cylinder head 20 and the valve cover 29 have been rotated through 180° when fitted onto the crankshaft housing 10.

FIG. 2*c* shows the plan view onto the generator set in the assembly shown in FIGS. 2*a*, 2*b*. Compared to the plan view in FIG. 1*c*, the plan view shown in FIG. 2*c* again makes it clear that the cylinder head 20 can be mounted onto the crankshaft housing 10 in two different orientations.

FIG. 3 clearly shows the internal layout of the two-cylinder piston engine 1 with the two camshafts 11, 12, which have spur gears 34, 35 respectively. The teeth of the spur gears 34, 35 intermesh, and thereby synchronise the movement of the pistons 18, 19. The pistons are guided inside the cylinders 21, 22, not shown here, in a tandem arrangement. That means that the pistons 18, 19 arrive at their top and bottom dead centres at the same time.

In FIG. 3 it is also apparent that four valves 25 in total are provided, which can be actuated via rocker arms 26. The rocker arms 26 are coupled with the four control rods 33, to each of which is assigned a cam 32 of the camshaft 30.

With regard to the crankshafts 11, 12, it is also apparent that these have in each case a flywheel 14, 15 on the sides opposite the drive wheels 36, 37. Here each flywheel has a balance mass 16, in order to reduce vibrations during the operation of the two-cylinder piston engine 1. At least the first flywheel 14, which is connected to the first crankshaft 11, has circumferential markings 17. With the aid of the circumferential markings 17 a crankshaft sensor can detect the current positions of the pistons 18, 19 in the cylinders 21, 22. Here a broader marking indicates the top or bottom dead centre of the pistons 18, 19.

From the attached drawings it is apparent that as a result of the option of fitting the cylinder head 20 onto the crankshaft housing 10 in different orientations, the installation conditions for the generator set can be individually adapted. At the same time the lower-mounted camshaft 30 results in a particularly compact build of the generator set. In overall terms it is therefore possible to reduce the necessary build space in a vehicle.

LIST OF REFERENCE SYMBOLS

1 Two-cylinder piston engine
10 Crankshaft housing
11 First crankshaft
12 Second crankshaft
13 Piston rod
14 First flywheel
15 Second flywheel
16 Balance mass
17 Circumferential markings
18 First piston
19 Second piston
20 Cylinder head
21 First cylinder
22 Second cylinder
23 Intake stub pipe
24 Outlet stub pipe
25 Valve
26 Rocker arm
27 Electronics housing
28 Cover
29 Valve cover
30 Cam shaft
31 Belt drive
32 Cam
33 Control rod
34 First spur gear
35 Second spur gear
36 First drive wheel
37 Second drive wheel
39 Toothed wheel
41 First generator
42 Second generator

The invention claimed is:

1. A hybrid vehicle generator apparatus comprising:

a two-cylinder piston engine having a crankshaft housing;

two counter-rotating crankshafts configured and arranged in the crankshaft housing, the crankshafts connected by piston rods to pistons guided inside the two cylinders of the piston engine in a tandem arrangement, wherein at least one crankshaft is drivingly connected to a generator, and wherein the piston engine has a cylinder head connected to the crankshaft housing, wherein each crankshaft carries a flywheel having a balance mass, wherein at least one flywheel has external tooth forms spaced at equal intervals, wherein at one point on the at least one flywheel, a gap between tooth forms is longer than the equal intervals to act as a circumferential marking in order to detect a crankshaft position using a crankshaft sensor; and a lower-mounted camshaft such that the cylinder head is connectable to the crankshaft housing in one of at least two positions having 180° relative rotation to each other.

2. The hybrid vehicle generator apparatus of claim 1, wherein the camshaft is configured and arranged in a central plane between the crankshafts.

3. The hybrid vehicle generator apparatus of claim 1, wherein the camshaft is configured and arranged below a dead center bottom of the pistons.

4. The hybrid vehicle generator apparatus of claim 1 further comprising:

an intake stub pipe included in the cylinder head for an ignition mixture; and an outlet stub pipe for exhaust gases, wherein the intake stub pipe and the outlet stub pipe are configured and arranged on different faces of the cylinder head.

5. The hybrid vehicle generator apparatus of claim 1, wherein the camshaft is drivingly connected to one of the crankshafts via one of a belt drive and a chain drive.

6. The hybrid vehicle generator apparatus of claim 1, wherein the camshaft has at least one cam coupled to one or more control rods operatively connected to a rocker arm of a valve in the cylinder head.

7. The hybrid vehicle generator apparatus of claim 5, wherein the camshaft includes at least four cams each of which is coupled to the one or more control rods.

8. The hybrid vehicle generator apparatus of claim 6, wherein the one or more control rods is configured and arranged between the two cylinders.

9. The hybrid vehicle generator apparatus of claim 1, wherein the crankshafts each carry a toothed spur gear, and wherein the spur gears of the two crankshafts intermesh such that the crankshafts couple in phase with each other.

10. A hybrid vehicle generator apparatus comprising:

a two-cylinder piston engine having a crankshaft housing;

two counter-rotating crankshafts configured and arranged in the crankshaft housing, the crankshafts connected by piston rods to pistons guided inside the two cylinders of the piston engine in a tandem arrangement, wherein at least one crankshaft is drivingly connected to a generator, and wherein the piston engine has a cylinder head connected to the crankshaft housing, wherein each crankshaft carries a flywheel having a balance mass, wherein at least one flywheel has external tooth forms spaced at equal intervals, wherein at one point on the at least one flywheel, gap between tooth forms as longer than the equal intervals to act as a circumferential marking in order to detect a crankshaft position using a crankshaft sensor; and a lower-mounted camshaft such that the cylinder head is connectable to the crankshaft housing in one of at least two positions having 180° relative rotation to each other, wherein the camshaft is configured and arranged in a central plane between the crankshafts.

11. The hybrid vehicle generator apparatus of claim 10, wherein the camshaft is configured and arranged below a dead center bottom of the pistons.

12. The hybrid vehicle generator apparatus of claim 10 further comprising:

an intake stub pipe included in the cylinder head for an ignition mixture; and an outlet stub pipe for exhaust gases, wherein the intake stub pipe and the outlet stub pipe are configured and arranged on different faces of the cylinder head.

13. The hybrid vehicle generator apparatus of claim 10, wherein the camshaft is drivingly connected to one of the crankshafts via one of a belt drive and a chain drive.

14. The hybrid vehicle generator apparatus of claim 10, wherein the camshaft has at least one cam coupled to one or more control rods operatively connected to a rocker arm of a valve in the cylinder head.

15. The hybrid vehicle generator apparatus of claim 14, wherein the camshaft includes at least four cams each of which is coupled to the one or more control rods.

16. The hybrid vehicle generator apparatus of claim 15, wherein the one or more control rods is configured and arranged between the two cylinders.

17. The hybrid vehicle generator apparatus of claim 10, wherein the crankshafts each carry a toothed spur gear, and wherein the spur gears of the two crankshafts intermesh such that the crankshafts couple in phase with each other.

18. A hybrid motor vehicle comprising:

a two-cylinder piston engine having a crankshaft housing;

two counter-rotating crankshafts configured and arranged in the crankshaft housing, the crankshafts connected by piston rods to pistons guided inside the two cylinders of the piston engine in a tandem arrangement, wherein at least one crankshaft is drivingly connected to a generator, and wherein the piston engine has a cylinder head connected to the crankshaft housing, wherein each crankshaft carries a flywheel having a balance mass, wherein at least one flywheel has external tooth forms spaced at equal intervals, wherein at one point on the at least one flywheel, gap between tooth forms is longer than the equal intervals to act as a circumferential marking in order to detect a crankshaft position using a crankshaft sensor; and a lower-mounted camshaft such that the cylinder head is connectable to the crankshaft housing in one of at least two positions having 180° relative rotation to each other.

* * * * *